US007162960B2

(12) United States Patent
Smyrniotis et al.

(10) Patent No.: US 7,162,960 B2
(45) Date of Patent: Jan. 16, 2007

(54) PROCESS FOR REDUCING PLUME OPACITY

(75) Inventors: Christopher R. Smyrniotis, St. Charles, IL (US); Emellto P. Rivera, Rolling Meadows, IL (US); Frank J. Zuccarini, Naperville, IL (US)

(73) Assignee: Fuel Tech, Inc., Batavia, IL (US)

( * ) Notice: Subject to any disclaimer, the term of this patent is extended or adjusted under 35 U.S.C. 154(b) by 79 days.

(21) Appl. No.: 10/754,072

(22) Filed: Jan. 8, 2004

(65) Prior Publication Data

US 2005/0150441 A1 Jul. 14, 2005

(51) Int. Cl.
*F23J 15/00* (2006.01)
*F23B 7/00* (2006.01)

(52) U.S. Cl. ..... 110/345; 110/342

(58) Field of Classification Search ..... 110/342, 110/343, 344, 345

See application file for complete search history.

(56) References Cited

U.S. PATENT DOCUMENTS 4,377,118 A * 3/1983 Sadowski ..... 110/343
6,206,685 B1 * 3/2001 Zamansky et al. ..... 431/4

* cited by examiner

*Primary Examiner*—Kenneth Rinehart
(74) *Attorney, Agent, or Firm*—Thaddius J. Carvis

(57) ABSTRACT

Plume is mitigated by targeting treatment chemicals to locations in a furnace, which are connected with plume opacity. The effectiveness of targeted in furnace injection, in fuel introduction and in furnace introduction of slag and/or corrosion and/or plume control chemicals are determined, as are the effectiveness of targeted in furnace injection, in fuel introduction and in furnace introduction of combustion catalysts. Then, the effectiveness of various combinations of the above treatments are determined, and a treatment regimen employing one or more of the above treatments is selected. Preferred treatment regimens will contain at least two and preferably three of the treatments. Chemical utilization and boiler maintenance can improved as LOI carbon, slagging and/or corrosion are also controlled.

11 Claims, No Drawings

PROCESS FOR REDUCING PLUME OPACITY

BACKGROUND OF THE INVENTION

The invention relates to a process for reducing the opacity of plume released to the atmosphere from large-scale combustors, such as the type used industrially and by utilities to provide power and incinerate waste. According to the invention, plume opacity is mitigated, preferably while improving combustion and/or reducing slag and/or corrosion. The invention achieves one or more of these desired results through the use of various combinations of combustion catalysts, slag modifiers, targeted in-furnace injection, and/or in-body injection.

The combustion of carbonaceous fuels, such as heavy fuel oils, coals, refinery coke, and municipal and industrial waste, typically produces a plume arising from the smoke stack and can have opacity ranging from low to high. In addition, these fuels contain slag-forming materials, and can generate corrosive acids, and unburned carbon, that in combination have a relatively negative effect on the productivity of the boilers, and can corrode the environment and pose a health risk.

Plume is a problem from an aesthetic standpoint as well as an environmental one. Plume can be objectionable in and of itself and is expensive to treat by conventional technology. The negative effects of plume are considered to be related to the opacity of emissions from power plants. Plume opacity is measured in percent. Simply, the greater the opacity, the more the background behind the plume is obscured and the less light can come through the plume. If none of the background is obscured, then the opacity is 0%. If the entire background is obscured, then the opacity is 100%.

The visibility impairment effects of power plant plumes can be grouped into three categories. The first, opacity, occurs very near the stack and is determined by EPA Reference Method 9 is found in 40 CFR Part 60, Appendix A. It was adopted as a visible emissions inspection method in an effort to standardize the training and certification of observers and to ensure that reliable and repeatable opacity observations could be conducted anywhere in the United States. The second, plume blight, occurs at distances from 2 km to 1 day's travel downwind. Blight happens before the plume has been dispersed so widely that it is indistinct from the background. Regional haze is the effect of the plume on a broader scale and is obviously of critical concern. Coal and oil fired power plants, especially, produce small particles in plumes from when sulfur dioxide ($SO_2$) is oxidized to sulfur trioxide ($SO_3$) inside a furnace and boiler, condenses with water ($H_2O$) at lower temperatures to become suspended sulfuric acid aerosol particles. $SO_3$ also reacts with alkali metals to form various sulfates. Sulfate particles can significantly contribute to the concentration of very fine particle matter ($PM_{2.5}$), which is associated with health as well as reduced visibility. Desulfurization, e.g., flue gas desulphurization (FGD), of the entire effluent can be used to decrease plume from coal-fired boilers by decreasing the overall $SO_2$ content of the effluent. The invention, by decreasing plume opacity, directly affects opacity and is believed to greatly reduce an individual plant contribution to the other two categories of visibility impairment.

While plume opacity is of concern from an external pollution position, slagging and some of the other problems caused by combustion can affect efficiency—therefore, economics, which are a severe threat to older power plants, especially, where efficiency is required for pollution controls to be affordable for maintaining the plants in operation. Slagging deposits are sometimes extremely difficult to remove by conventional techniques such as soot blowing. Slag buildup results in a loss of heat transfer throughout the system, increases draft loss, limits gas throughput and is a factor in tube failure due to erosion from excessive soot-blowing. A variety of other procedures are known for adding treatment chemicals to the fuel or into the furnace in quantities sufficient to treat all of the ash produced, in the hope of solving the slagging problem. Typical chemicals include magnesium oxide and magnesium hydroxide for the above reasons and various combustion catalysts, such as copper, iron, calcium, to improve the burning of the fuel.

Corrosion, typically occurs to a greater degree at the cold end of the combustor, and can create maintenance costs that are desirably avoided. Acid gases and deposits can often be controlled by the addition of chemicals to the combustion chamber or the fuel. The introduction of chemicals in this manner is often very inefficient and increases the amount of ash that must be disposed. Corrosion control is too often a choice between polluting byproducts.

The art has endeavored to solve slagging and/or corrosion problems by introducing various chemicals, such as magnesium oxide or hydroxide. Magnesium hydroxide has the ability to survive the hot environment of the furnace and react with the deposit-forming compounds, raising their ash fusion temperature and thereby modifying the texture of the resulting deposits. Unfortunately, the introduction of the chemicals has been very expensive due to poor utilization of the chemicals, much simply going to waste and some reacting with hot ash that would not otherwise cause a problem. U.S. Pat. No. 5,740,745 and U.S. Pat. No. 5,894,806 deal with this problem, by introducing chemical in one or more stages to directly address predicted or observed slagging and/or corrosion.

The presence of unburned carbon in the ash is an indication that combustion is not efficient and can cause operational problems. Increasing the amount of air used for combustion can reduce carbon in the ash, often referred to as LOI carbon (for loss on ignition, denoting a weight loss of ash due to combustion of its carbon content). This can be effective in some situations, but the use of excess air always decreases boiler efficiency. Also, excess air increases $SO_2$ to $SO_3$ conversion, causing additional acid aerosol plume and may also increase NOx levels. The use of combustion catalysts can also be effective in some cases; however, combustion catalysts cannot always be used effectively or efficiently due to fuel and/or equipment limitations. Among combustion catalysts proposed in the art are the metal compounds in the form of basic metal salts, generally calcium, iron, copper and magnesium compounds. Generally the metal compounds are delivered as metal salts. The anionic portion of the salt can be hydroxyl, oxide, carbonate, borate, nitrate, etc. Carbon in the ash can decrease commercial value of the ash, which can be used in concrete if the LOI can be reduced to less than 2%.

The art is in need of a process that can efficiently deal with plume, while preferably permitting efficient combustion with lower LOI carbon, lower excess air, lower CO, and/or lower $NO_x$, and/or controlling slag, and/or corrosion.

BRIEF DESCRIPTION OF THE INVENTION

It is an object of the invention to improve the operation of large-scale combustors by efficiently mitigating plume.

It is another object of the invention to improve the operation of large-scale combustors by efficiently mitigating plume, while preferably controlling slag and/or corrosion at the same time that LOI carbon is mitigated.

It is another object of the invention to enable the treatment of many boilers with an effectiveness that has heretofore escaped those skilled in the art.

It is a further object of the invention to mitigate plume with reduced chemical treatment costs in many boilers and synergies in others.

A yet further, but related, object is to mitigate the costs resulting from any or all of the aforementioned problems by reducing their occurrence.

A yet further object is to increase combustor output.

These and other objects are achieved by the present invention which provides an improved process for improving the operation of combustors, comprising: burning a carbonaceous fuel containing a combustion catalyst; determining combustion conditions within a combustor that can benefit from targeted in-furnace treatment chemical; locating introduction points on the furnace wall where introduction of targeted in-furnace treatment chemical could be accomplished; and, based on the determinations of the previous step, introducing targeted in-furnace treatment chemical.

In another embodiment, the invention provides a process, which comprises: burning a carbonaceous fuel containing a combustion catalyst and a slag and/or corrosion controlling chemical; determining combustion conditions within a combustor that can benefit from targeted in-furnace treatment chemical for control of slag and/or corrosion; locating introduction points on the furnace wall where introduction of targeted in-furnace treatment chemical could be accomplished; and, based on the determinations of the previous step, introducing targeted in-furnace treatment chemical.

The invention also provides a process of system analysis for pollutant control. According to this aspect of the invention, the effectiveness of targeted in furnace injection, in fuel introduction and in furnace introduction of slag and/or corrosion and/or plume control chemicals are determined, as are the effectiveness of targeted in furnace injection, in fuel introduction and in furnace introduction of combustion catalysts. Then, the effectiveness of various combinations of the above treatments are determined, and a treatment regimen employing one or more of the above treatments is selected. Preferred treatment regimens will contain at least two and preferably three of the treatments.

The invention has several preferred aspects, which are described in greater detail below.

DETAILED DESCRIPTION OF THE INVENTION

The invention relates to a process for reducing plume, preferably while improving combustion and/or reducing slag and/or corrosion in large-scale combustors, such as of the type used industrially and by utilities to provide power and incinerate waste. The following description will illustrate the invention with reference to a power plant type boiler fired with heavy, e.g., number 6, fuel oil. It will be understood however, that any other combustor fueled with any other carbonaceous fuel and susceptible to the problems treated by the invention could benefit from the invention. Without meaning to be limiting of the type of fuel, carbonaceous materials such as fuel oil, gas, coal, waste, including municipal and industrial, sludge, and the like, can be employed.

In general, the combustion of carbonaceous fuels, such as heavy fuel oils, coal and municipal and industrial waste, result in effluents having significant plume opacity and can cause slag formation, corrosive acids, that individually and in combination have relatively negative effect on the productivity and social acceptability of the boilers. The invention addresses these problems in a manner that is economically attractive and surprising in effectiveness. The invention provides an improved process for improving the operation of combustors. Important to the process is the determination of combustion conditions within a combustor that can affect plume. The invention can be used to treat plume alone or with one or more of LOI carbon, slagging and corrosion in the absence of treatment.

The process will entail burning a carbonaceous fuel with or without a combustion catalyst and introducing targeted in-furnace treatment chemical directed at problem areas or to locations where the chemical can do the most good. This latter step will require locating introduction points on the furnace wall where introduction of chemicals to control plume could be accomplished. The invention, thus, can be facilitated by the use of computational fluid dynamics and modeling or observation according to the teachings of U.S. Pat. No. 5,740,745 and U.S. Pat. No. 5,894,806. In addition to the specifically identified techniques, those skilled in the art will be able to define other techniques effective for locating the problem areas and, from them, determining the best locations to introduce chemical. The teachings of these patents will not be repeated here, but are incorporated by reference in their entireties to explain suitable techniques effective for the invention.

Among the preferred targeted in-furnace injection chemicals are combustion catalysts (e.g., potassium, barium, calcium, cerium, iron, copper, zinc, magnesium, manganese, etc.) in various forms, and the oxides and hydroxides of magnesium for example, in the form of slurries or solutions in water or other suitable vehicle. The slag-reducing agent is most desirably introduced as an aqueous treatment solution, a slurry in the case of magnesium oxide or magnesium hydroxide. The concentration of the slurry will be determined as necessary to assure proper direction of the treatment solution to the desired area in the boiler. Typical concentrations vary from 1 to 100%, e.g., and are typically within the range of from about 51 to about 80% active chemical by weight of the slurry or solution, preferably from about 5 to about 30%. Other effective metal oxides and hydroxides (e.g., copper, titanium and blends) are known and can be employed. These chemicals, or others, such as copper oxychloride, copper carbonate, iron oxide, organometallics of iron, copper, calcium, supplied in a dosage to make 1 to 1000 ppm (typical 40–50 ppm) as active metal in the fuel by weight.

Important to the invention and a departure from known prior art in the field, is the introduction of a combustion catalyst with the fuel or with targeted in-furnace chemical effective for improving the oxidation of the fuel, in combination with the targeted in-furnace treatment chemical. The combustion catalyst will be any material effective for the intended purpose and preferably comprises a metal compound wherein the metal is selected from the group consisting of copper, iron, magnesium and calcium. It can include fuel dispersible or fuel soluble compositions. Among these, are chemical compounds which affect the combustion process, such as salts of organic acids, such as naphthenates, octoates, tallates, salts of sulfonic acids, saturated or unsaturated fatty acids, such as oleic acid, and tall oil, with metals from the group of K, Ba, Mg, Ca, Ce, Fe, Mn, Zn; rare earth metals; organometallic compounds, such as carbonyl compounds, mixed cyclopentadienyl carbonyl compounds, or aromatic complexes of the transition metals Fe or Mn. One preferred catalyst composition is calcium nitrate which can be supplied in the form 50% to 66% water solution at a dosage rate of from 1 to 1000 ppm @ ~0.5 lb/ton or 40–50 ppm as active metal) as active metal in the fuel by weight. Variation in the amounts will be initially determined by calculation and adjusted following testing. Variations of up to 100% of the indicated values will be expected, and up to about 25% of the values will be more typical.

In addition to the addition of combustion catalyst to the fuel, and a targeted in-furnace addition of chemical, the process of the invention will entail, in some preferred embodiments, the use of an in-furnace treatment chemical added to the carbonaceous fuel. The chemical can be the same or different from the targeted in-furnace injection chemical. In one scenario, total magnesium use can be about 0.6 kg per 1000 kg of fuel with 30–40% going low in the furnace or in the fuel and 60–70% going targeted higher in the furnace with targeted in-furnace injection (TIFI). The combustion catalyst is typically introduced at a dosage rate of from about 0.1 to about 2.0, e.g., about 0.2 to about 0.8, kg per 1000 kg of carbonaceous fuel burned in the combustor. In some preferred configurations, the targeted treatment chemical is introduced into the furnace at a dosage rate of from about 0.2 to about 1.2, e.g., from about 0.32 to about 0.46, kg per 1000 kg of carbonaceous fuel burned in the combustor Variation in the amounts will be initially determined by calculation and adjusted following testing. Variations of up to 100% of the indicated values will be expected, and up to about 25% of the values will be more typical.

Targeted injection of the in-furnace injection chemical will require locating introduction points on the furnace wall where introduction of targeted in-furnace treatment chemical could be accomplished. And, based on the determinations of this procedure, targeted in-furnace treatment chemical is introduced, such as in the form of a spray. The droplets are desirably in an effective range of sizes traveling at suitable velocities and directions to be effective as can be determined by those skilled in the art. These drops interact with the flue gas and evaporate at a rate dependent on their size and trajectory and the temperatures along the trajectory. Proper spray patterns result in highly efficient chemical distributions.

As described in the above-identified patents, a frequently used spray model is the PSI-Cell model for droplet evaporation and motion, which is convenient for iterative CFD solutions of steady state processes. The PSI-Cell method uses the gas properties from the fluid dynamics calculations to predict droplet trajectories and evaporation rates from mass, momentum, and energy balances. The momentum, heat, and mass changes of the droplets are then included as source terms for the next iteration of the fluid dynamics calculations, hence after enough iterations both the fluid properties and the droplet trajectories converge to a steady solution. Sprays are treated as a series of individual droplets having different initial velocities and droplet sizes emanating from a central point.

Correlations between droplet trajectory angle and the size or mass flow distribution are included, and the droplet frequency is determined from the droplet size and mass flow rate at each angle. For the purposes of this invention, the model should further predict multi component droplet behavior. The equations for the force, mass, and energy balances are supplemented with flash calculations, providing the instantaneous velocity, droplet size, temperature, and chemical composition over the lifetime of the droplet. The momentum, mass, and energy contributions of atomizing fluid are also included. The correlations for droplet size, spray angle, mass flow droplet size distributions, and droplet velocities are found from laboratory measurements using laser light scattering and the Doppler techniques. Characteristics for many types of nozzles under various operating conditions have been determined and are used to prescribe parameters for the CFD model calculations. When operated optimally, chemical efficiency is increased and the chances for impingement of droplets directly onto heat exchange and other equipment surfaces is greatly reduced. Average droplet sizes within the range of from 20 to 1000 microns are typical, and most typically fall within the range of from about 100 to 600 microns.

One preferred arrangement of injectors for introducing active chemicals for reducing slag in accordance with the invention employ multiple levels of injection to best optimize the spray pattern and assure targeting the chemical to the point that it is needed. However, the invention can be carried out with a single zone, e.g., in the upper furnace, where conditions permit or physical limitations dictate. Typically, however, it is preferred to employ multiple stages, or use an additive in the fuel and the same or different one in the upper furnace. This permits both the injection of different compositions simultaneously or the introduction of compositions at different locations or with different injectors to follow the temperature variations which follow changes in load.

The total amount of the in-furnace treatment chemical introduced into the combustion gases from all points should be sufficient to obtain a reduction in plume opacity and/or corrosion and/or the rate of slag build-up and/or the frequency of clean-up. The build-up of slag results in increased pressure drop through the furnace, e.g., through the generating bank. Dosing rates can be varied to achieve long-term control of the noted parameters or at higher rates to reduce slag deposits already in place.

It is a distinct advantage of the invention that plume can be well controlled at the same time as corrosion, slag LOI carbon, and/or $SO_3$. The net effect in many cases is a synergy in operation that saves money and/or increases efficiency in terms of lower stack temperatures, cleaner air heater surfaces, lower corrosion rates in the air heaters and ducts, lower excess $O_2$, cleaner water walls, resulting in lower furnace exit temperatures and cleaner heat transfer surfaces in the convection sections of the boiler.

The process of the invention can be looked at from the unique perspective of system analysis. According to this aspect of the invention, the effectiveness of targeted in furnace injection, in fuel introduction and in furnace introduction of slag and/or corrosion and/or plume control chemicals are determined, as are the effectiveness of targeted in furnace injection, in fuel introduction and in furnace introduction of combustion catalysts. Then, the effectiveness of various combinations of the above treatments are determined, and a treatment regimen employing one or more of the above treatments is selected. Preferred treatment regimens will contain at least two and preferably three of the treatments. In each case, a determination can be any evaluation whether or not assisted by computer or the techniques of the above-referenced patents. In addition, it may involve direct or remote observation during operation or down times. The key factor here and a departure from the prior art is that targeted injection is evaluated along with nontargeted introduction, especially of a combination of combustion catalysts and slagging and/or corrosion and/or plume control chemicals. Chemical utilization and boiler maintenance can improved as LOI carbon, slagging and/or corrosion are also controlled.

The following examples are provided to further illustrate and explain the invention, without being limiting in any regard. Unless otherwise indicated, all parts and percentages are based on the weight of the composition at the particular point of reference.

EXAMPLE 1

In this example, magnesium hydroxide was fed to the fuel oil for a residual oil fired electric power plant boiler at a rate of 0.20 kg per 1000 kg. Magnesium hydroxide was also directed into the boiler at positions determined by computational fluid dynamic modeling as described in U.S. Pat. No. 5,894,806, at a rate of 0.20 kg per 1000 kg. In addition, a calcium nitrate combustion catalyst was added to the fuel oil at a rate of 0.25 kg per 1000 kg. The magnesium hydroxide fed the fuel oil performed two roles: it protected the lower furnace against slagging and hot-side corrosion by the mechanism of tying up vanadium in the oil. The magnesium hydroxide also prevented fouling caused by the catalyst from affecting lower furnace cleanliness. Most catalysts used for fossil fuels can also cause fouling in the lower furnace. Data showed base line opacities of 25% opacity and excess $O_2$ levels of 1.5%–2.0%. When the invention was introduced after a CFD model was run, opacity dropped to approximately 4.0% and excess $O_2$ was lowered to approximately 0.5%. It was observed that such operation on the unit had never been achieved before, as the fuel analysis is typically 250 ppm vanadium, 2.0% sulfur and 12% asphaltenes, which makes it impossible to achieve these results with in-body injection alone.

EXAMPLE 2

A similar set as in Example 1 is run with similar treatment to reduce opacities from 30% to 7%. In this case, the combustion catalyst is fed at a rate of 0.25 kg per 1000 kg of fuel, and the in-furnace injection chemical is Mg, which is fed at a rate of 0.35 kg per 1000 kg of fuel.

The above description is for the purpose of teaching the person of ordinary skill in the art how to practice the invention. It is not intended to detail all of those obvious modifications and variations, which will become apparent to the skilled worker upon reading the description. It is intended, however, that all such obvious modifications and variations be included within the scope of the invention which is defined by the following claims. The claims are meant to cover the claimed components and steps in any sequence which is effective to meet the objectives there intended, unless the context specifically indicates the contrary.

The invention claimed is:

1. A process for improving the operation of combustors, comprising:

burning a carbonaceous fuel containing a combustion catalyst comprising calcium nitrate;

determining combustion conditions within a combustor that can benefit from targeted in-furnace treatment chemical, wherein determinations are made by calculation including computational fluid dynamics and observation;

locating introduction points on the furnace wall where introduction of targeted in-furnace treatment chemical could be accomplished; and, based on the determinations of the previous steps, providing a treatment regimen for introducing targeted in-furnace treatment chemical to locations within the combustor where improvements will result in reducing the opacity of plume, improving combustion and/or reducing slag and/or reducing LOI carbon and/or reducing corrosion.

2. A process for reducing the opacity of plume released to the atmosphere from large-scale combustors, comprising:

determining the effectiveness of targeted in furnace injection of slag and/or corrosion and/or plume control chemicals;

determining the effectiveness of adding slag and/or corrosion and/or plume control chemicals to the fuel;

determining the effectiveness of adding combustion catalysts to the fuel;

determining the effectiveness of adding combustion catalysts to the furnace;

determining the effectiveness of targeted in furnace injection of combustion catalysts;

determining the effectiveness of various combinations of the above treatments;

wherein determinations are made by calculation including computational fluid dynamics and observation;

selecting a treatment regimen employing at least two of the above treatments; and implementing the treatment regimen selected by the step above by introducing a combustion catalyst with the fuel or by targeted in-furnace injection and introducing a targeted in-furnace treatment chemical to control plume, the regimen thereby reducing the opacity of plume and improving combustion and/or reducing slag and/or reducing LOI carbon and/or reducing corrosion.

3. A process according to claim 2 wherein the combustion catalyst is introduced either in-fuel or in-furnace at a dosage rate of from about 0.2 to about 0.8 kg per 1000 kg of carbonaceous fuel burned in the combustor.

4. A process according to claim 2 wherein the targeted treatment chemical is introduced into the furnace at a dosage rate of from about 0.2 to about 0.5 kg per 1000 kg of carbonaceous fuel burned in the combustor.

5. A process according to claim 4 wherein targeted treatment chemical is introduced at more than one elevation.

6. A process according to claim 2, wherein the combustion catalyst comprises a metal compound wherein the metal is selected from the group consisting of copper, iron, magnesium, calcium, cerium, barium, and zinc.

7. A process according to claim 2, wherein the targeted treatment chemical is magnesium oxide or magnesium hydroxide in a vehicle.

8. A process according to claim 7 wherein the concentration of the targeted treatment chemical in a slurry or solution is within the range of from about to about 100%.

9. A process according to claim 2, wherein the selected treatment regimen comprises at least three of the above treatments.

10. A process according to claim 9, wherein the combustion catalyst comprises a metal compound wherein the metal is selected from the group consisting of copper, iron, magnesium, calcium, cerium, zinc, and barium.

11. A process according to claim 9, wherein the targeted treatment chemical is a slurry of magnesium oxide or magnesium hydroxide.

* * * * *